US008632374B2

(12) United States Patent
Nuñez

(10) Patent No.: US 8,632,374 B2
(45) Date of Patent: Jan. 21, 2014

(54) SALVAGE SUIT FOR SHIPWRECKS

(75) Inventor: Karina Beatriz Nuñez, Provincia de Bueonos Aires (AR)

(73) Assignee: Mario César Vignola, Buenos Aires (AR)

( * ) Notice: Subject to any disclaimer, the term of this patent is extended or adjusted under 35 U.S.C. 154(b) by 569 days.

(21) Appl. No.: 12/940,580

(22) Filed: Nov. 5, 2010

(65) Prior Publication Data

US 2011/0107504 A1 May 12, 2011

(51) Int. Cl.

| | |
|---|---|
| ***B63C 9/02*** | (2006.01) |
| ***B63C 9/06*** | (2006.01) |
| ***B63C 9/087*** | (2006.01) |
| ***B63C 9/105*** | (2006.01) |
| ***B63B 35/58*** | (2006.01) |

(52) U.S. Cl.
USPC ..... 441/102; 441/40; 441/87; 441/88; 441/103

(58) Field of Classification Search
USPC ..... 441/35, 38, 40–42, 80, 87, 88, 441/102–120; 114/322–325; 2/458, 2.15, 2/2.16
See application file for complete search history.

(56) References Cited

U.S. PATENT DOCUMENTS

| | | | | |
|---|---|---|---|---|
| 1,115,094 | A * | 10/1914 | Nowacki | 441/91 |
| 1,129,958 | A * | 3/1915 | Collins | 441/87 |
| 3,404,406 | A * | 10/1968 | Balliet | 2/2.16 |
| 3,521,628 | A * | 7/1970 | Piel | 128/201.27 |
| 4,599,075 | A * | 7/1986 | Nygard | 441/103 |
| 4,704,092 | A * | 11/1987 | Liukko | 441/104 |
| 4,734,072 | A * | 3/1988 | Lastnik | 441/105 |
| 7,013,489 | B1 * | 3/2006 | McGrath | 2/69 |
| 8,092,267 | B2 * | 1/2012 | Taylor et al. | 441/42 |
| 2010/0203781 | A1 * | 8/2010 | Gellatly | 441/129 |
| 2010/0248567 | A1 * | 9/2010 | Carl | 441/92 |

* cited by examiner

*Primary Examiner* — Ajay Vasudeva
(74) *Attorney, Agent, or Firm* — Paul L. Brown

(57) ABSTRACT

The present invention relates to a salvage or safety suit worn by a person escaping a shipwreck. The suit includes a receptacle structured to receive and enclose a person's body and a head opening for entering the receptacle. The receptacle is layered to provide flotation and thermo-insulation properties to the suit.

15 Claims, 17 Drawing Sheets

A

B

SALVAGE SUIT FOR SHIPWRECKS

This invention relates to miscellaneous industrial techniques and to means of transport such as ships and, consequently, to salvage equipments in the sea or in other water environments.

More specifically, it relates to a salvage suit for shipwrecks that lets maintain the wearer totally afloat, and said wearer can move inside the body receptacle; the suit prevents water from entering, insulates the wearer from cold, lets protect the area around the head, and lets collect rain water while the wearer waits being rescued.

BACKGROUND OF THE INVENTION

Until now, several salvation equipments are known that mainly include suits or dresses, into which the shipwrecked person's body is protected from aggressive factors that act before (fire, high temperature, etc.) and/or after (staying in water, low temperature, etc.) a shipwreck.

So, we know the suit included in patent document U.S. Pat. No. 1,102,772. This suit has two independent openings: the upper or head opening and the front or chest expansible opening. The latter is based on a precarious tight fitting system that may be freed and flood the suit inner bladder.

The patent document U.S. Pat. No. 1,314,299 shows a suit having inflatable chambers; those chambers do not cover the whole suit, but they are located in areas where bladders are filled with air that the wearer blows.

The patent document U.S. Pat. No. 2,181,150 shows a suit that is partially expansible, but that does not have any expansible sleeve. This suit does not have any mean to cover the head or the face, and it is prepared just to float vertically.

The patent document U.S. Pat. No. 2,761,154 shows a suit into which the wearer enters through an upper opening having expansible capacity, that then may be tightened around the face. Even though the upper end of the suit may be expanded until it has a tubular form, in fact no tubular sleeves are added. This suit also floats vertically. Its materials are waterproof, but they are not thermo-insulating. It also requires inflatable bladders to maintain flotation.

The patent document U.S. Pat. No. 4,242,769 uses small bladders to provide thermo-insulation and floatability, but these bladders are not permanently close and they have to be inflated. Consequently, in order to perform that function, they have to be blown up.

The patent document U.S. Pat. No. 4,599,075 refers to a suit that protects the head and face, that provides hygienic capacity to collect urine and feces, that allows eating solid food and drinking liquids, and inside which the wearer can make certain movements. Those movements allow the wearer taking his arms out of the sleeves and moving his legs towards his trunk, rubbing parts of his body, etc. The movements can be made thanks to bellows or folds, the flexibility and material of which allow the wearer taking his arms out of the sleeves and putting his legs in fetal position. The wearer has to assume this position because of his exposure to cold, as this suit has not adequate protection against extreme temperatures.

The patent document U.S. Pat. No. 4,704,092 shows a garment whose walls comprise two alveolar plastic sheets, with a chamber of air between them, and that include aluminum heat-reflecting layers. This suit has not expansible sleeves in the upper opening and has not armors.

The patent document U.S. Pat. No. 5,560,043 shows a suit that, event though it does not have expansible sleeves, its head opening has two hoods: an outer hood and an inner hood that may overlap.

It is also known the fireproof suit of the patent document AR P040104230 of the same inventor than this one. This suit walls do not have the alveolar plastic layer component, its sewed and sealed gloves are made of rubber and asbestos, it has not a hoisting armor or an expansible outer sleeve capable of protecting and collecting water, and it is a suit that fits to the wearer's body.

It is also known the permanence and salvage suit of the patent document AR P080101604 of the same inventor than this one. This suit walls do not have an outer layer that, with the inner layer, form an insulating hermetic bladder. It also requires using clothes having a vest and a hood that the wearer has to wear before entering into the suit.

Generally, neoprene conventional suits do not protect the wearer adequately from low temperatures. The cold outside liquid (sea, lake, river, etc. water) acts, through the neoprene, on the liquid and humidity existing between the body and the suit, and the temperature can reach 14° C. We have to note that liquids conduct 30 times faster than the air.

We have to add that the wet face exposed losses temperature because of the air accelerated conduction (between 20 and 60 Km/h. or more), cooling water drops that touch the face. This exposition to cold is very negative, and in some suits the following areas are also exposed: feet, wrists, hands and areas around zippers.

ADVANTAGES AND PURPOSES

This invention complies with several purposes and it has numerous advantages, to wit:

It allows the shipwrecked person entering into the suit quicker, as he is dressed, and this action is not hindered by the clothes or shoes that he is wearing.

The suit can be worn quicker, and so the shipwrecked ship evacuation can be made quicker.

The same opening that serves to wear the suit has an inner expansible sleeve that serves to contain and cover the head. This inner sleeve has multiple positions to close it, and this lets it act as a hood when it closes around the face, or completely cover the face by closing over it or close around the neck, leaving the head free.

If the outer sleeve is extended and close, the inner sleeve may remain open, and so the wearer can sit like in a kayak, leaving the head, trunk and hands inside the outer sleeve; this lets see and receive the rescue boat, ship or helicopter. When the outer sleeve is fit tight to the waist and the wearer sits like in a kayak, he can also work with his head, trunk and arms outside the suit.

When the outer sleeve is expanded and close, the wearer can look at him into the suit, use the oars supplied in it, drink water and eat food, throw his feces and urine, keeping the hygiene, make exercises, massages, take his vest off or wear it or other clothes, seal a wound, sleep, etc.

The outer sleeve expanded acts as an extra receptacle that lets the wearer remain protected from the waves, rain and winds, obtaining insulation against water.

The adequate management of the expandable sleeves lets take the excess of hot air from the inner receptacle or space, or accumulate heat, and even in case of rain, to collect fresh water between both expandable sleeves.

As both expandable sleeves are easily and quickly open, taking off and leaving the suit in the water is easier when the wearer enters into any rescue means of transport (ship, helicopter, etc.).

As the receptacle is spacious, different movements can be made inside the suit. For example: take the legs out of the suit legs toward the main part of the suit, take the arms out of the sleeves, change the different floating positions in order to be more comfortable, etc.

The capacity of flotation given by the alveolar sheets, the hermetic chambers and the body receptacle keep the suit almost completely out of the water, and this diminishes the area of body contact with the water and prevents the body from being exposed to cold, when the water temperature is low.

At the same time, the wearer protects his face, neck, hands and arms, he has a 100% hermetic barrier against water, and he gets an adequate protection against hypothermia. Consequently, the wearer can stay longer in cold water.

The insulation from the surrounding temperature occurs not just because of the presence of the air contained, but also because of a series of convection (within the covers and alveolar sheets) and transmittance (given by the micro-aluminized that can be double, i.e. two in each sheet) that are reinforced between them.

In convection processes, for example, the use of very low density alveolar layers contributes to diminish the interchange or the leakage speed from the hotter environment. In the air contained in the alveolar layers occurs the following: 1°) There is a convection process; 2°) A space having a very low mass density-area surrounding transmittance is created (Note: A high mass iron inhibits or diminishes transmittance, as opposed to an area without mass, that not only refracts, but also cannot accumulate or conduct in a mass that does not exist).

The potentiation of its thermal insulation through the different processes of convection, lack of conduction and transmittance causes an insignificant interchange of temperature between the wearer body and the water, and this allows him to stay in cold water for longer and, if the wearer was wet when he wore the suit, it lets the body recover its normal temperature. As this suit has a pronounced difference of floatability, more thermal resistance, and maintains a smaller surface of contact with the water, we also do not need to put our legs in fetal position to reduce the area exposed to cold.

This suit allows flotation with almost the whole body out of the water, and this allows swimming on one's back or on one's chest very easily (and so it is easy to face even opposite wind and/or current), being the additional advantage that, in case of a puncture, tearing or flooding, the suit inner bladder is not lost, as we also have the alveolar layers, the hermetic chambers and the body receptacle air.

The thermal insulation occurs not just because of the air contained, but also because of a series of convection processes (inside the fabric and in the alveolus—for example, integrated in the very low density alveolar layers, and so we diminish the interchange or the leakage speed from the hotter environment—and chambers of air existing between their layers) and transmittance (given by the micro-aluminized) that are reinforced between them. The potentiation of its thermal insulation through the several convection and transmittance processes almost annuls the temperature interchange between the wearer body and the water.

As this suit may include aluminum in the form of microsheets, this material generates phenomena that help maintaining the shipwrecked person temperature:

Internal transmittance inside the hollow fabric.

Transmittance toward the outside of the suit.

Internal transmittance toward the inside of the suit receptacle.

Convection in the area without conductors and projection to the whole insulation system: inside the fabric, the circular convection of the air confined in the alveolus and in their interalveolar spaces contributes to the internal transmittance process inside the layers, contributing to insulation. Consequently, the air confined is empowered because of the radiation and convection (inside each alveolus).

The tests made prove that, in different cold environments and under the wearer body temperature (36° C./37° C.), the suit receptacle temperature is constant at about 33° C. Immersion tests made in water at −2° C. with the head sleeve open during 8 hours (and the consequent heat loss through the head opening) proved that the receptacle temperature is 28° C. As the wearer normally has to stay still inside the receptacle, this is not just a survival temperature, but also a comfortable temperature. As the suit is as spacious as a cabin, it lets the wearer withdraw to the main part of the receptacle and take his arms and legs out of the sleeves and suit legs that are more exposed to getting cold.

The fact that the suit can float, keeping it partially out of the water, and that the receptacle creates a dry environment also contribute to the suit thermal capacity.

This suit has additional advantages: it lets the person swim on his stomach without wetting his face, it has no complex mechanisms (for ex. zippers), its operation is safer, it includes an outer cover that is highly resistant to frictions and to mechanical efforts, it includes a fireproof cover, etc.

I—BRIEF DESCRIPTION OF THE DRAWINGS

To clarify and understand better the aim of the invention, it is illustrated with several figures in which it was represented in one of its preferred forms of embodiment, as an illustrative, not limitative example:

Figure 1:
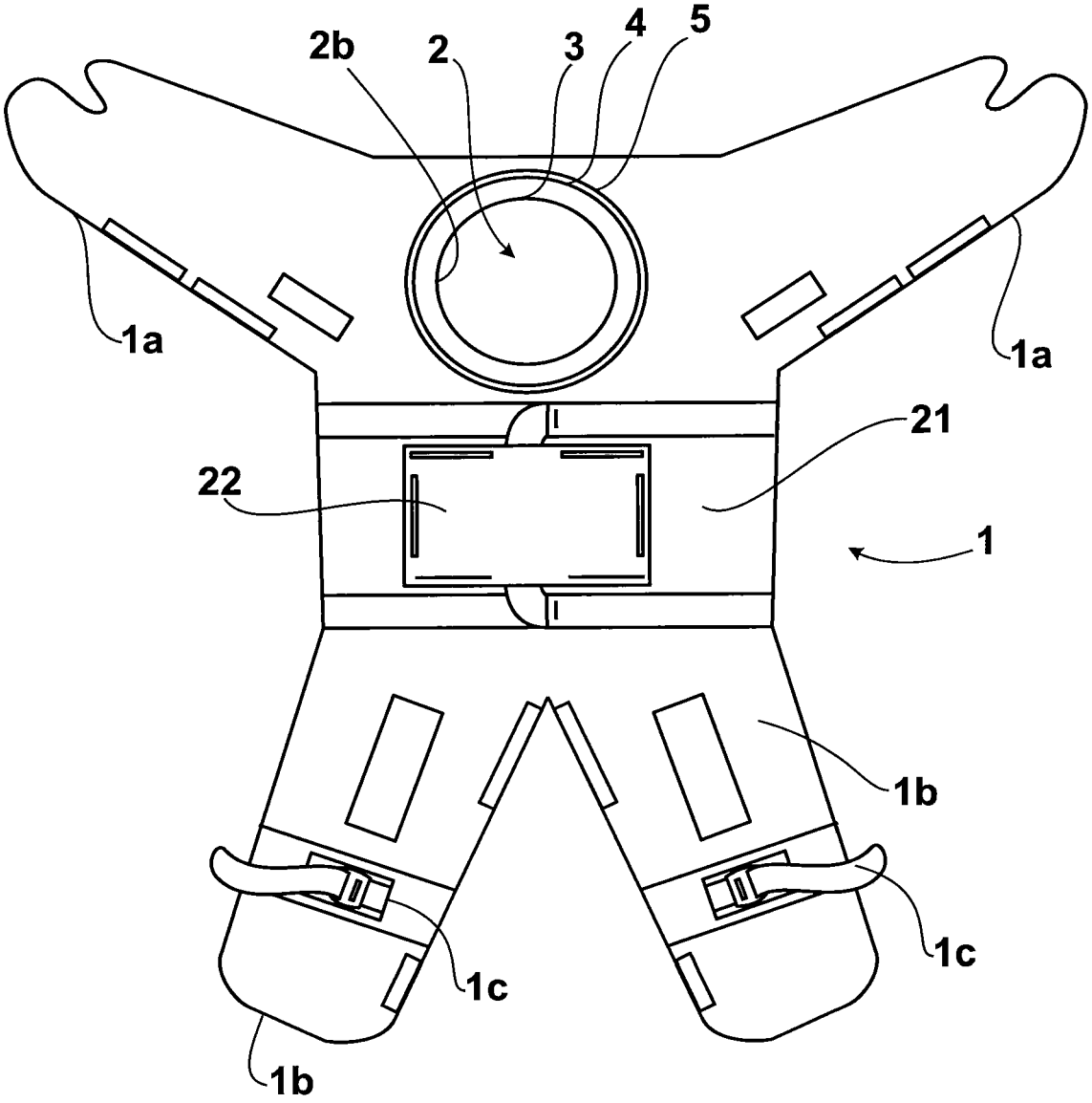
FIG. 1 is a top elevational view of this salvage suit.
Figure 2:
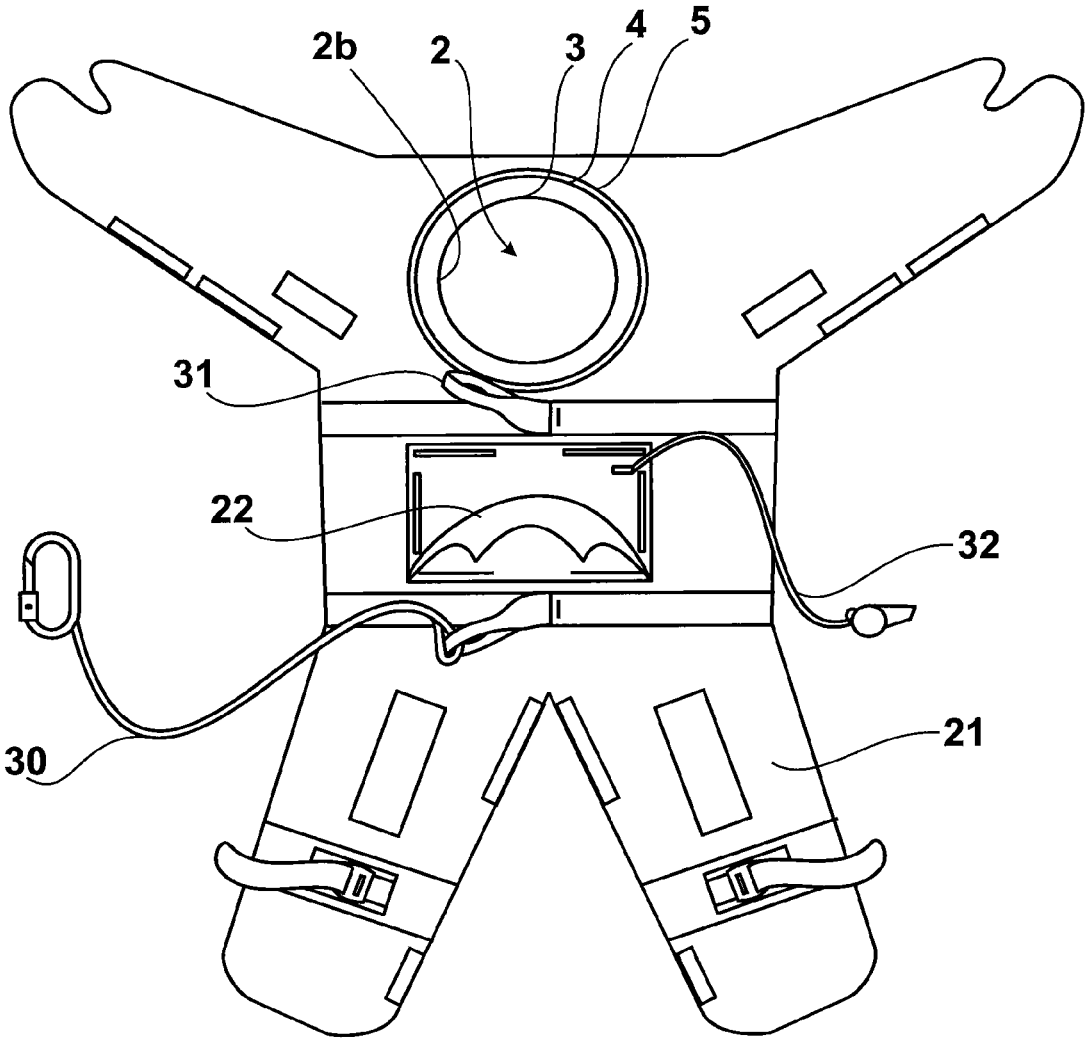
FIG. 2 is a top elevational view of this salvage suit, with some of its auxiliary elements expanded.
Figure 3:
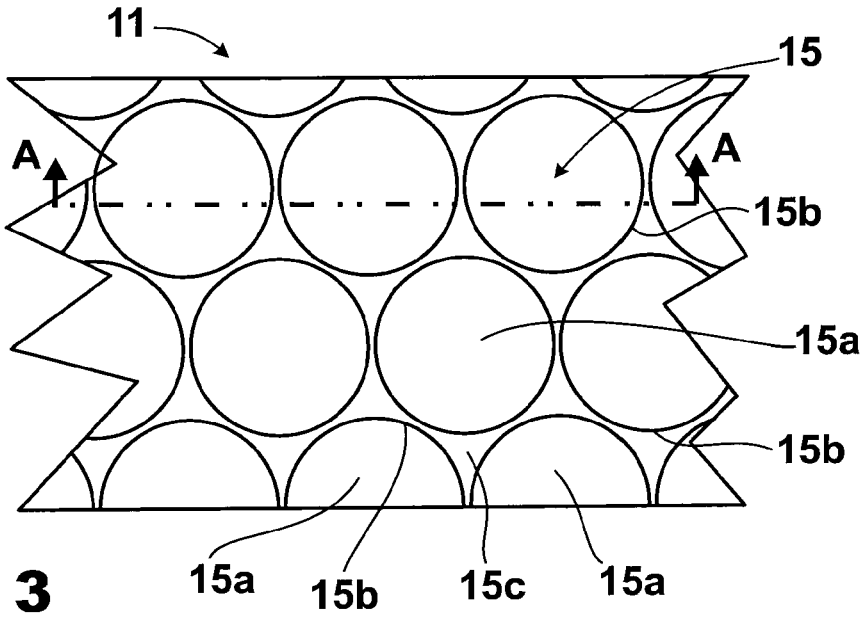
FIG. 3 is a detailed top elevational view of the inner bladder, in one of its possible forms of embodiment, in which the round alveolar compartments can be seen.
Figure 4:
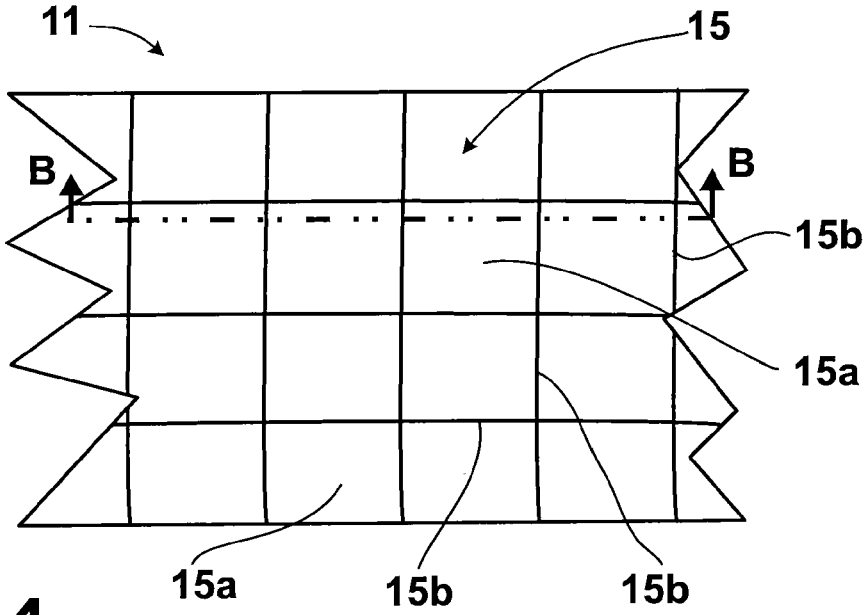
FIG. 4 is a top elevational view of a detail of the inner bladder, in another of its possible forms of embodiment, in which rectangular alveolar compartments can be seen.
Figure 5:
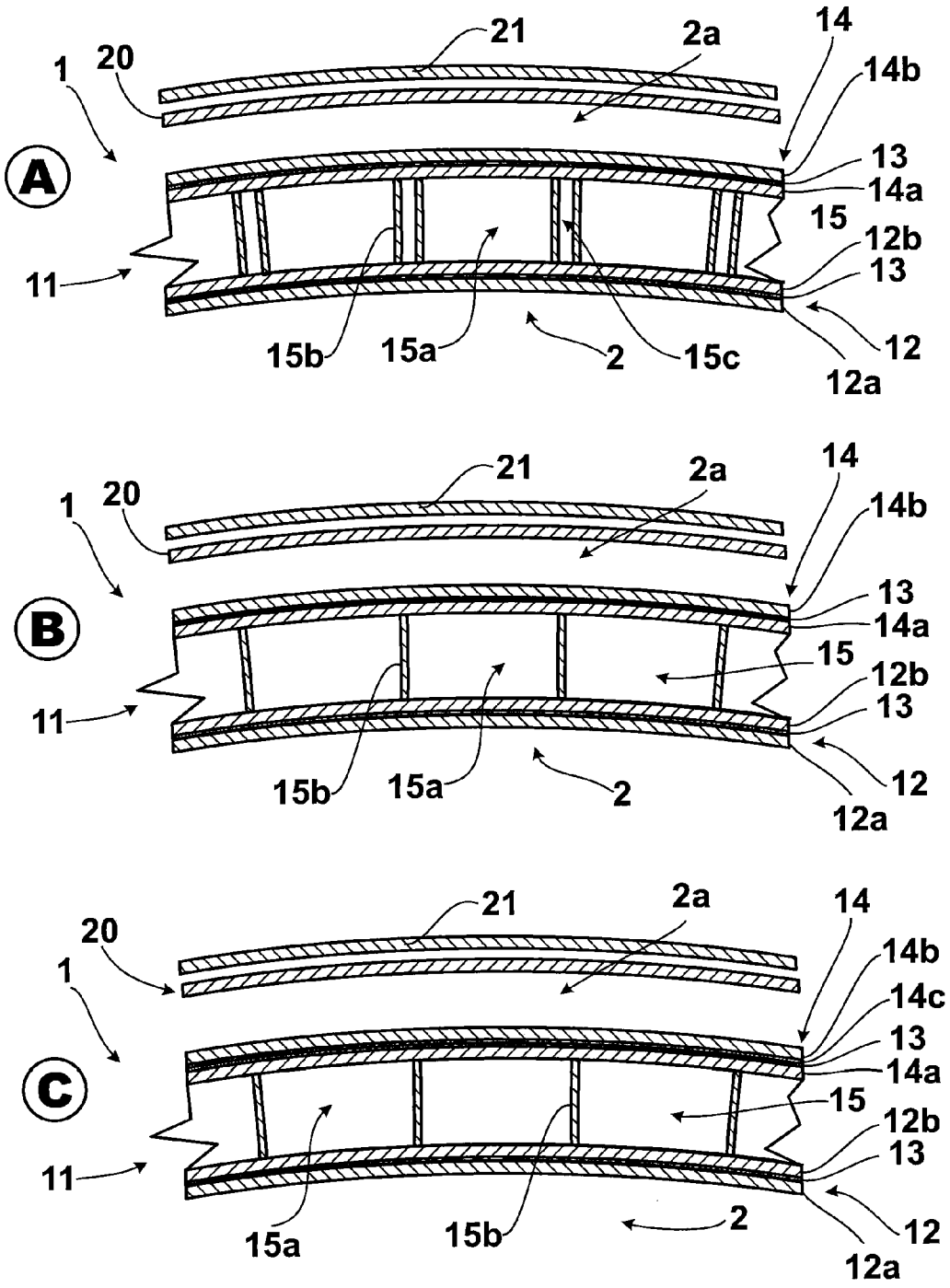

FIG. 5 includes drawings A, B and C, being:

Drawing A, a cross-sectional view of the inner and outer bladders, as indicated in a cross-sectional plan that appears indicated as A-A in FIG. 3;

Drawing B, a cross-sectional view of the inner and outer bladders, as indicated in a cross-sectional plan that appears indicated as B-B in FIG. 4, and Drawing C, a cross-sectional view of the inner and outer bladders in another form of embodiment.

Figure 6:
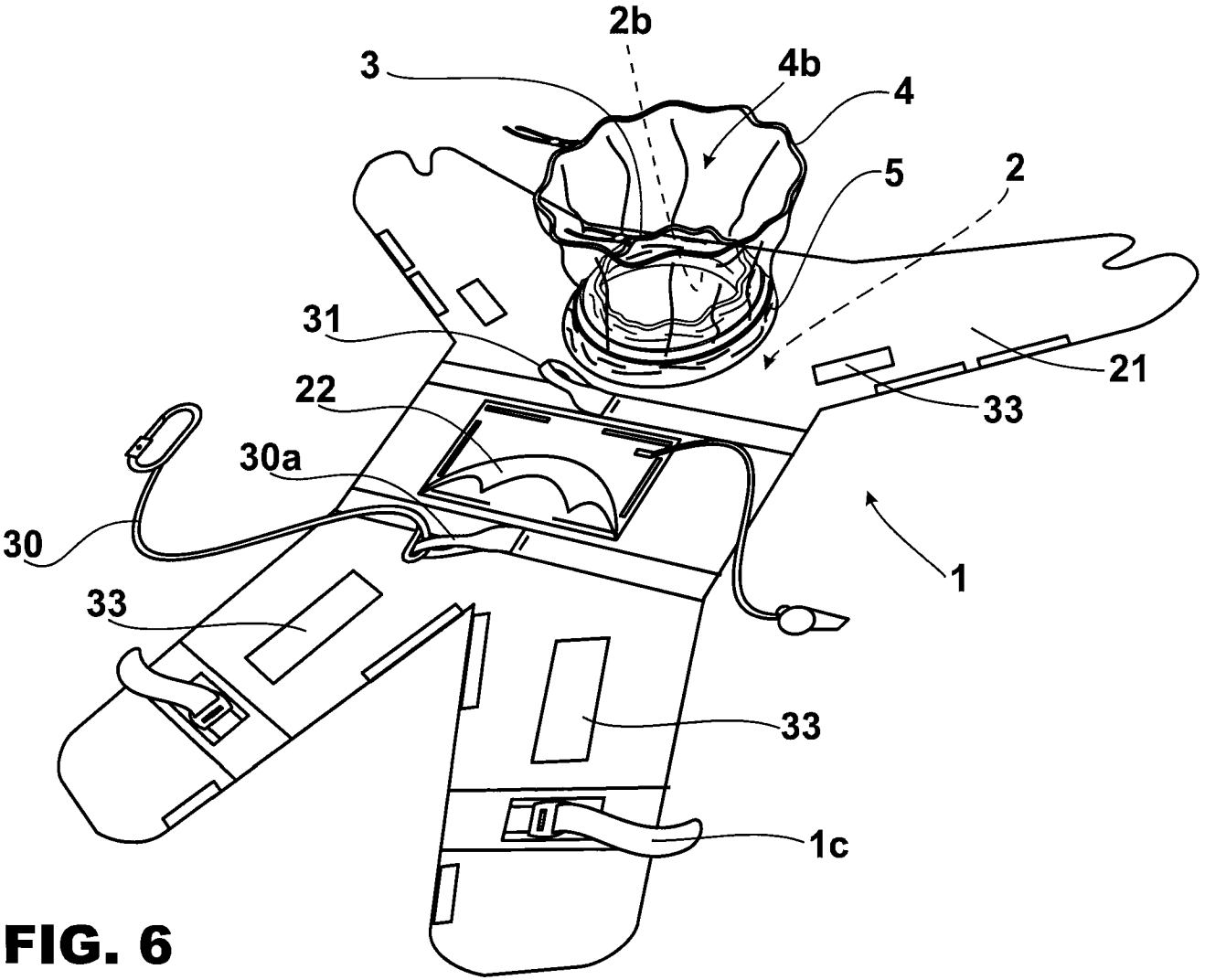

FIG. 6 is a perspective view of the salvage suit with its outer sleeve expanded.

Figure 7:
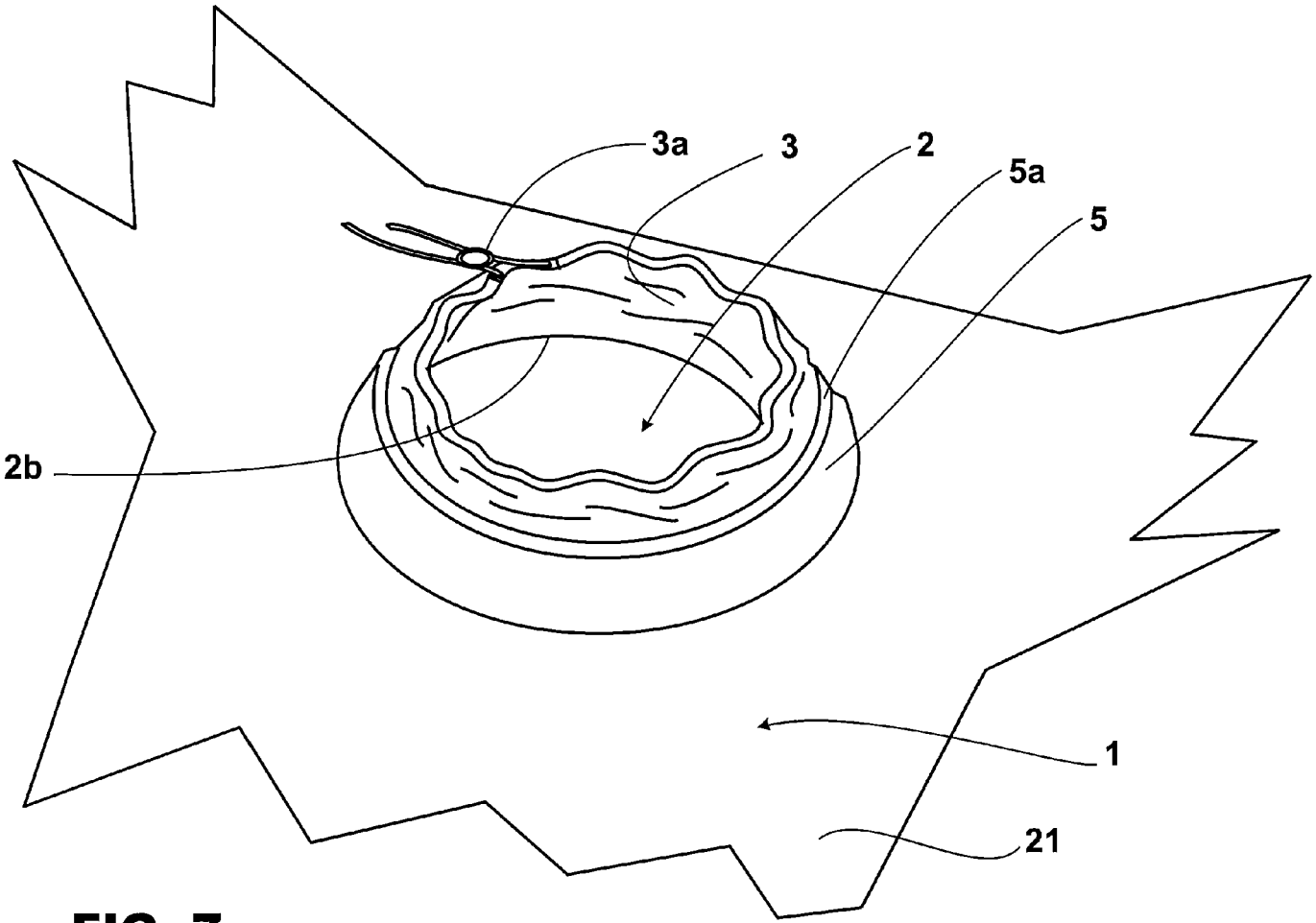

FIG. 7 is a perspective view of the top part of the salvage suit in which the head sleeve can be seen folded and surrounded by the protection sleeve.

Figure 8:
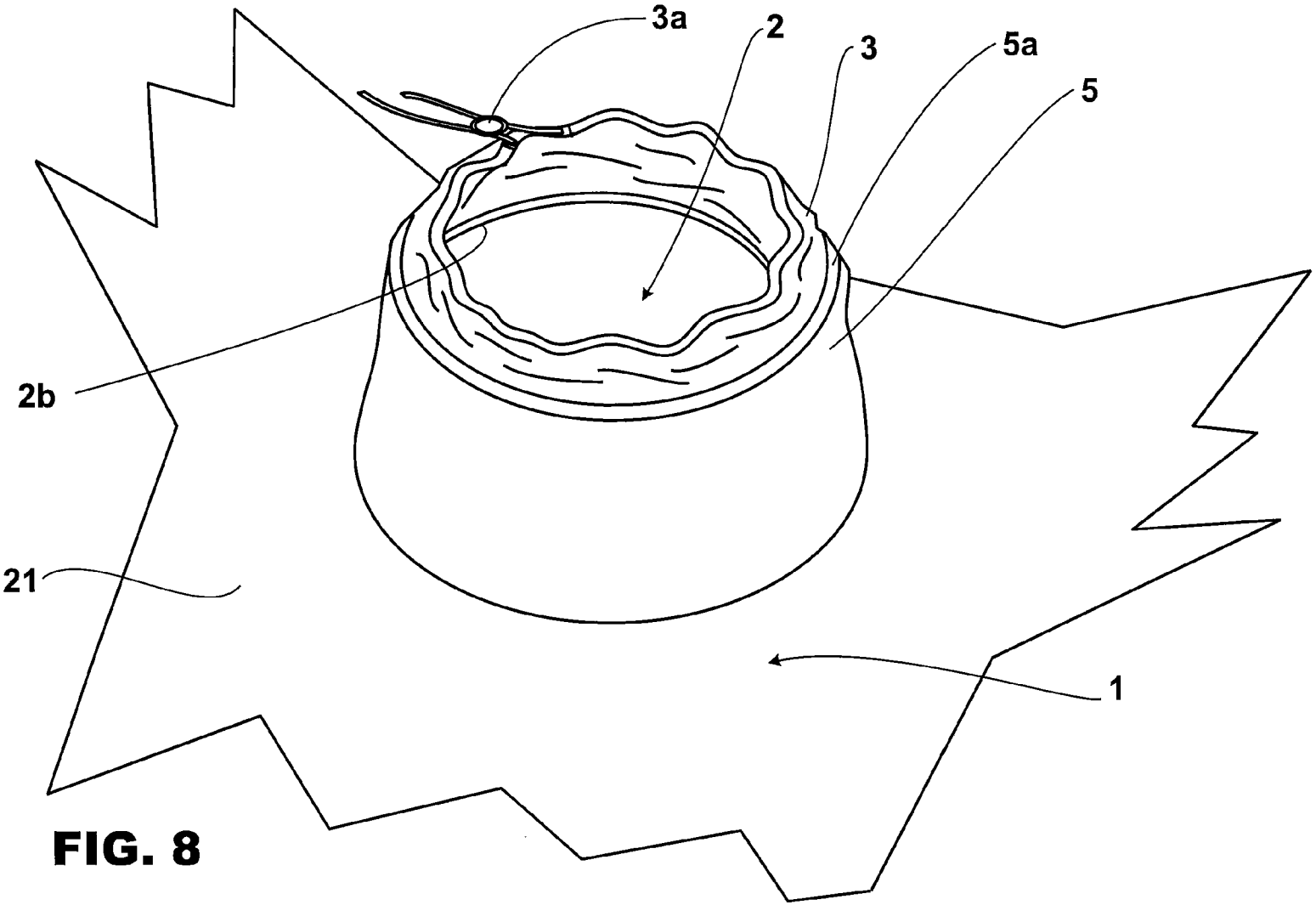

FIG. 8 is another perspective view of the top part of the salvage suit in which we can see how the expanded head sleeve is accompanied by the protection sleeve to which it is connected by a joint.

Figure 9:
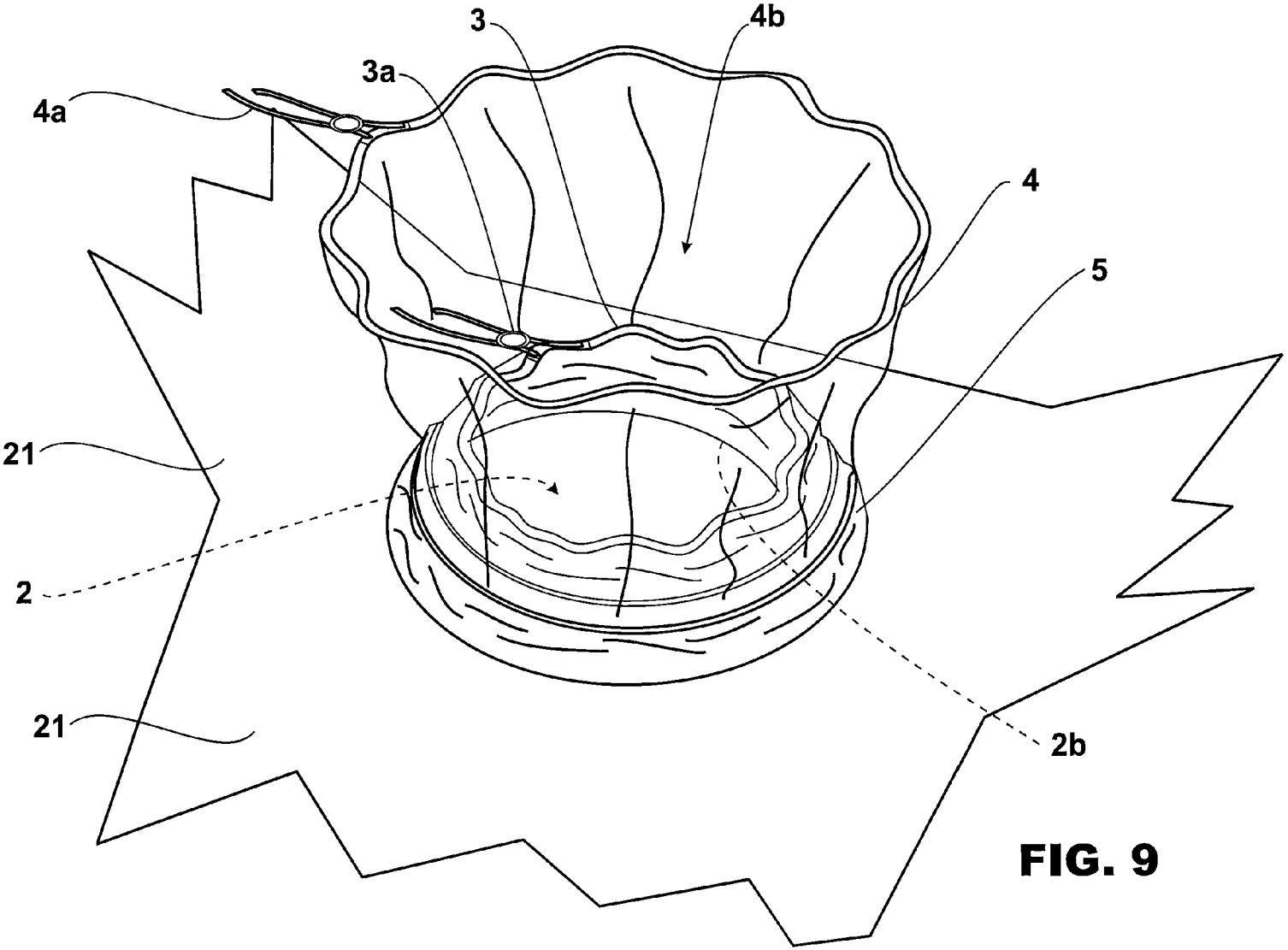

FIG. 9 is another perspective view of the top part of the salvage suit that shows the outer sleeve expansion around the head sleeve.

Figure 10:
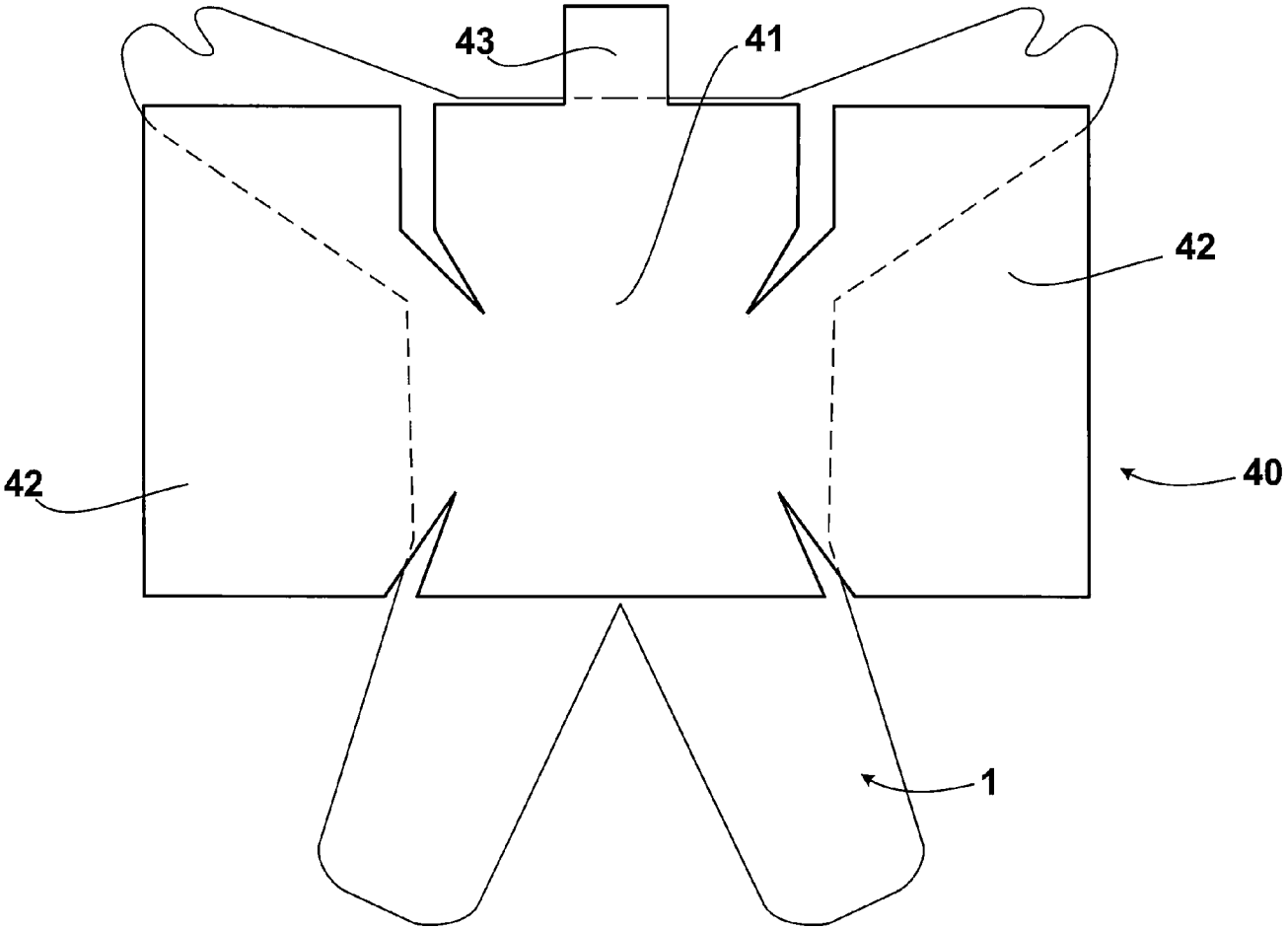

FIG. 10 is a top elevational view of the thermo-insulating device expanded and shown compared to the salvage suit contour.

Figure 11:
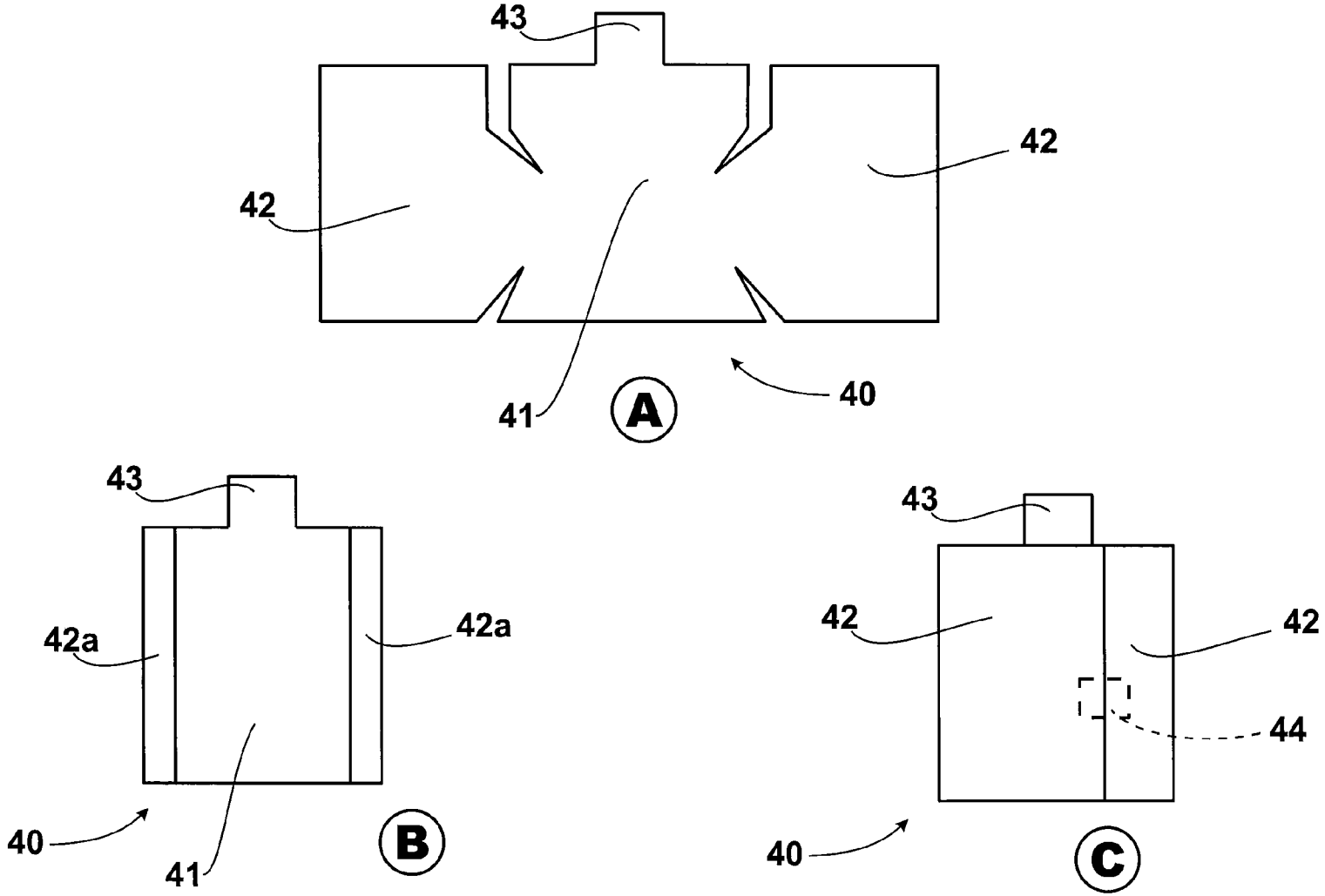

FIG. 11 includes drawings A, B and C, being:

Drawing A, a top elevational view of the thermo-insulating device expanded,

Drawing B, a top elevational view of the thermo-insulating device folded, not being used, with its wings rolled up, and Drawing C, a top elevational view of the thermo-insulating device folded, and wrapped.

Figure 12:
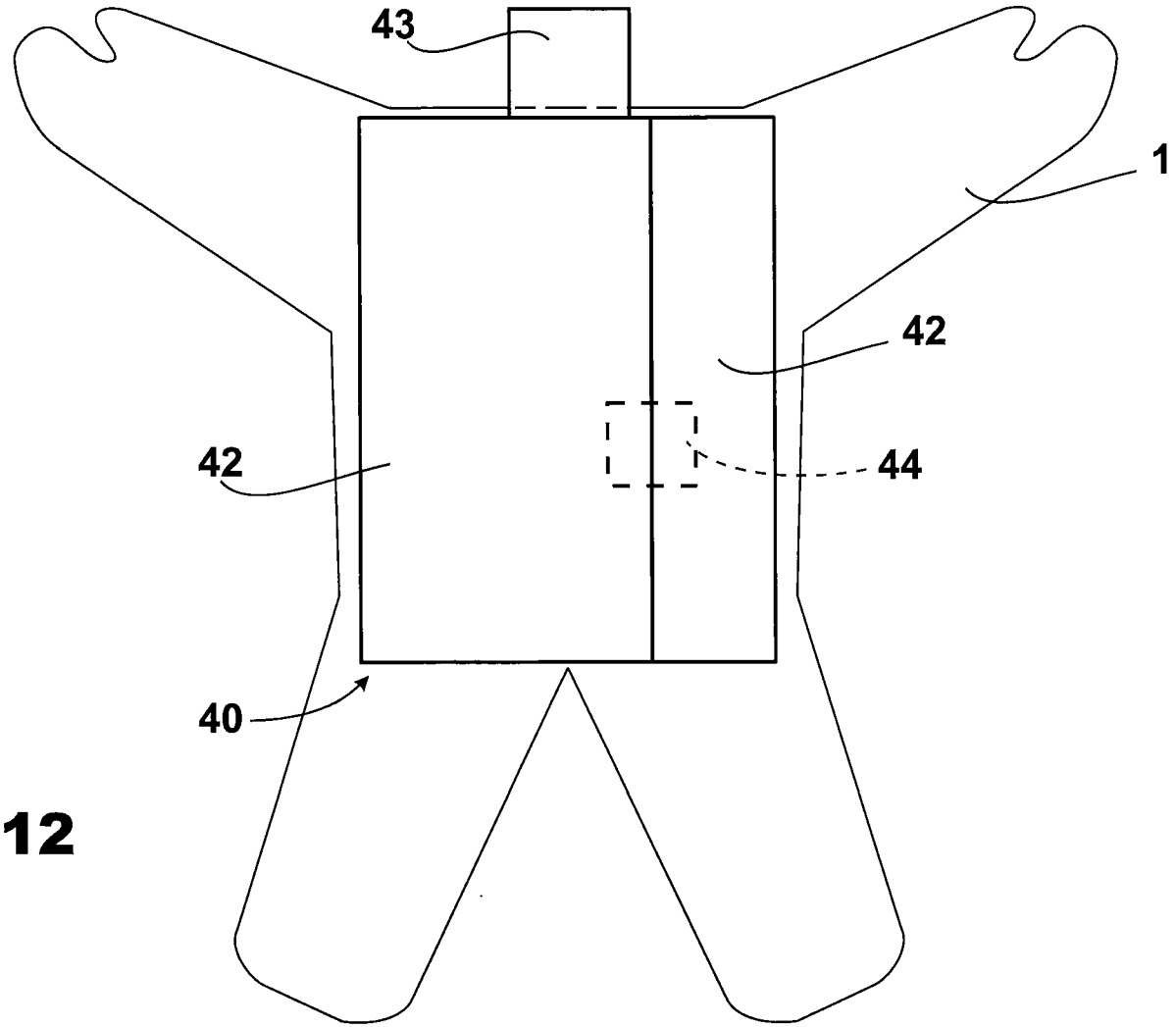

FIG. 12 is a top elevational view of the thermo-insulation device folded, wrapped, and shown compared to the salvage suit contour.

Figure 13:
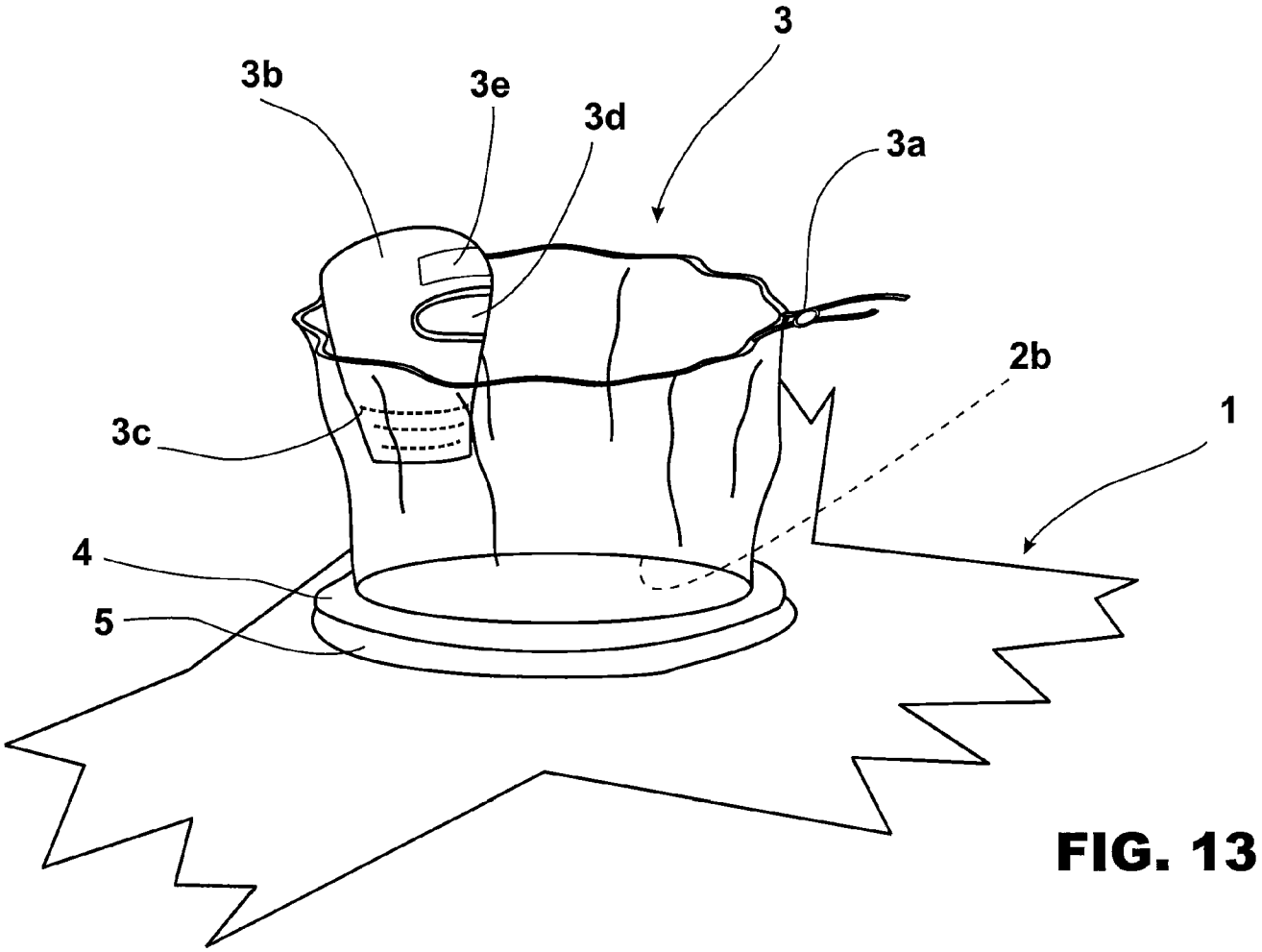

FIG. 13 is another perspective view of the top part of the salvage suit that shows the expansion of the outer expandable head sleeve supplied with a hood-type helmet.

Figure 14:
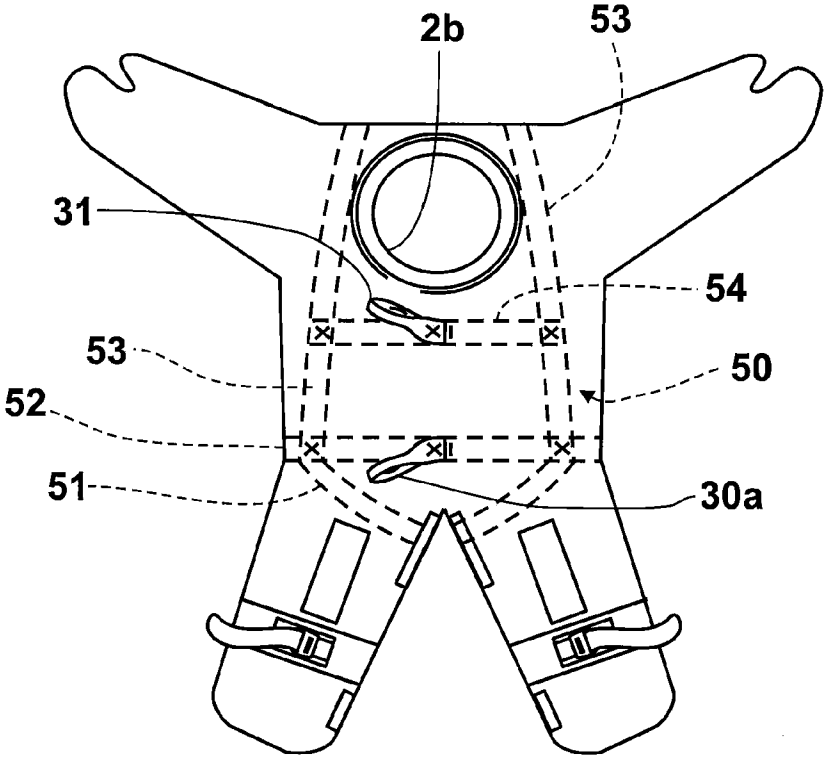

FIG. 14 is a top elevational view of this salvage suit in which the armor layout is shown.

Figure 15:
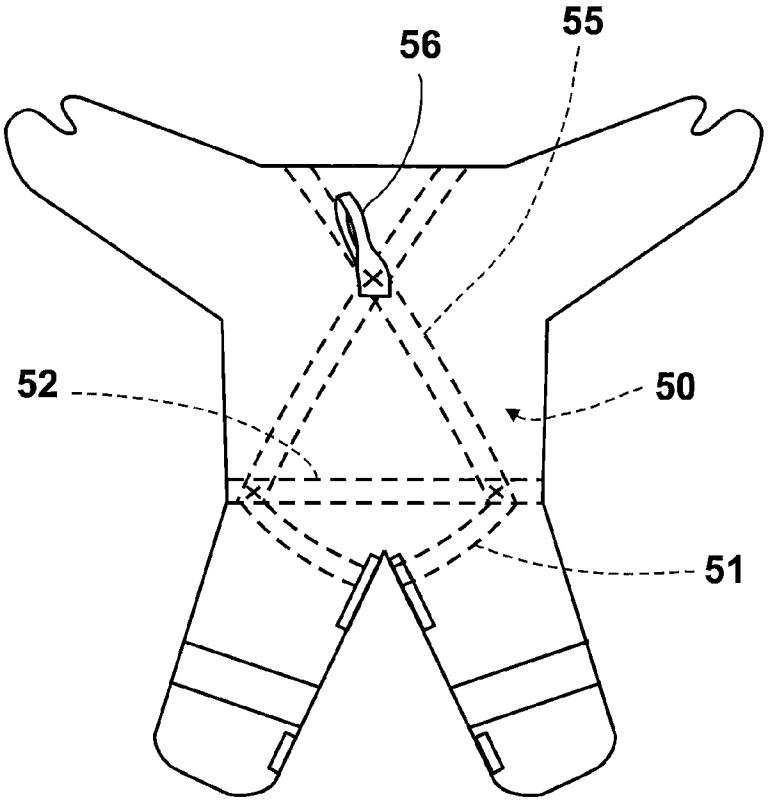

FIG. 15 is a rear elevational view of this salvage suit in which the armor layout is shown.

Figure 16:
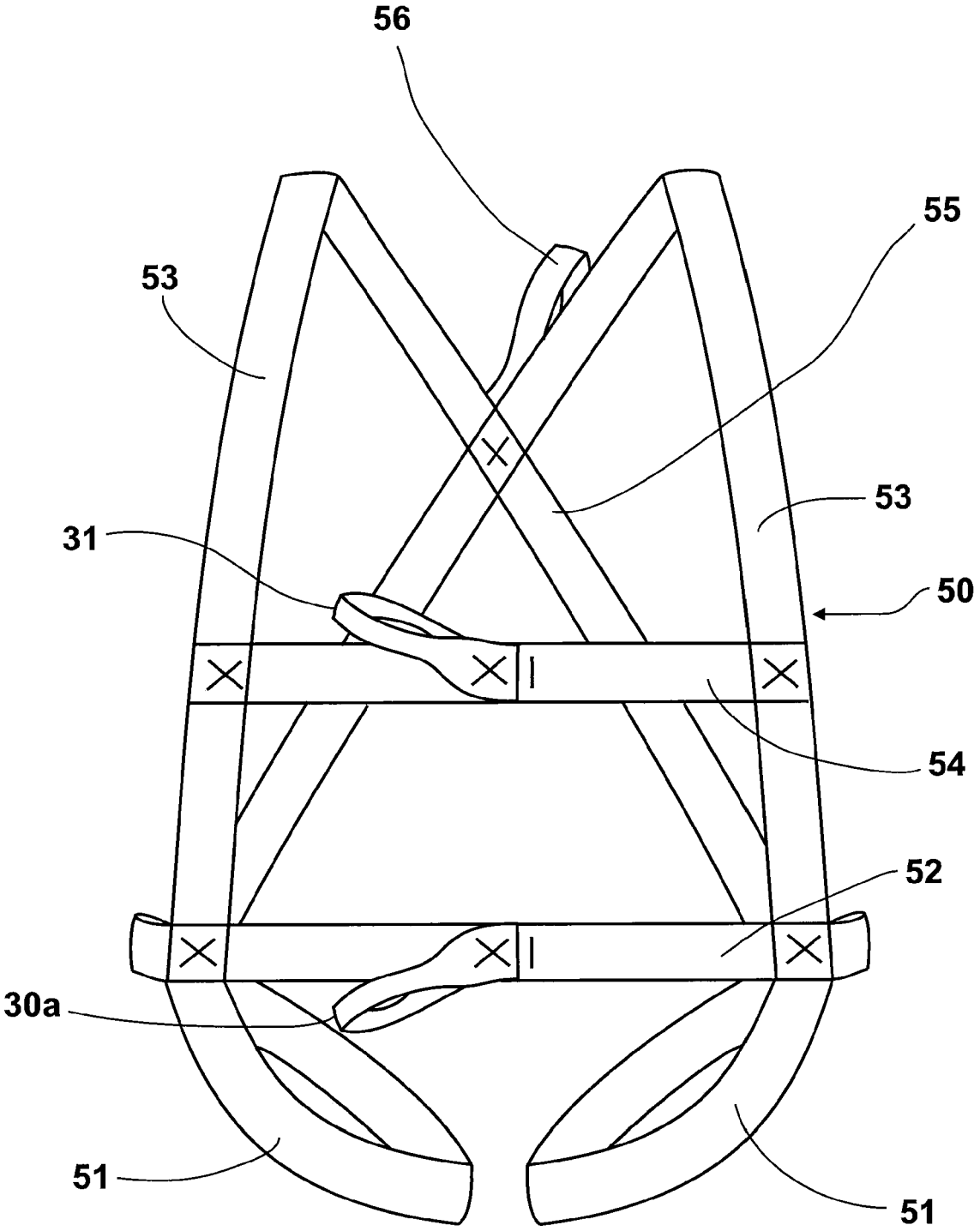

FIG. 16 is a top elevational view of the armor out of its normal assembly in the suit.

Figure 17:
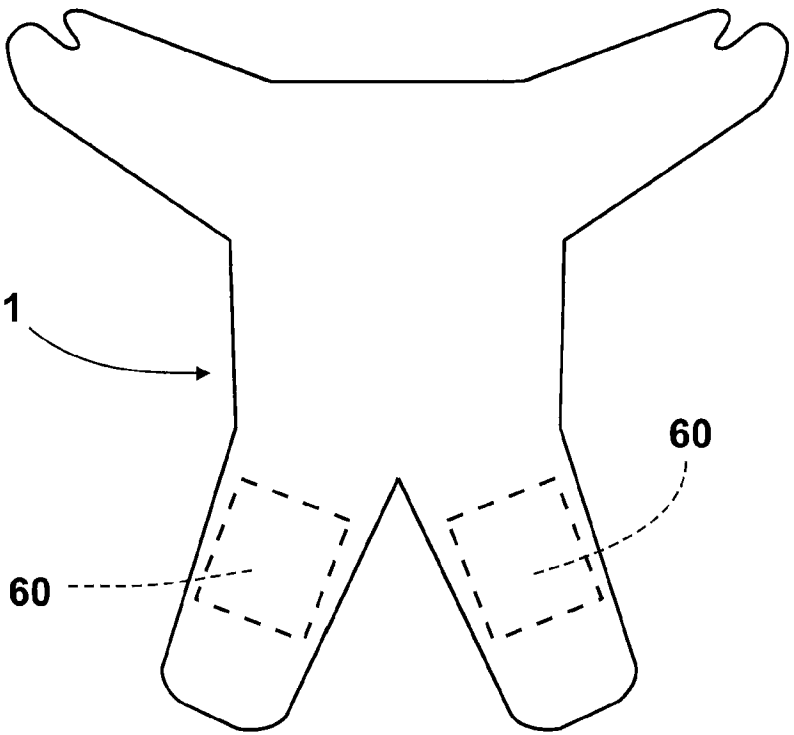

FIG. 17 is a rear elevational view of this salvage suit in which the suit legs thermo-insulating reinforcement location was shown.

Figure 18:
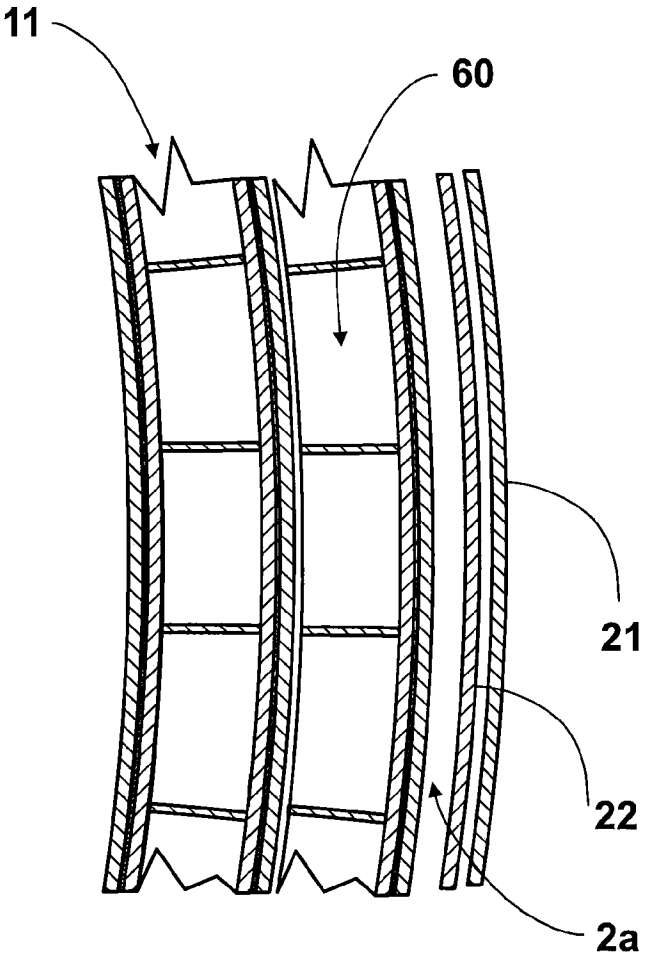

FIG. 18 is a detailed cross-sectional view of a leg suit wall showing the distribution of the inner and outer layers, with the thermo-insulating reinforcement between them.

Figure 19:
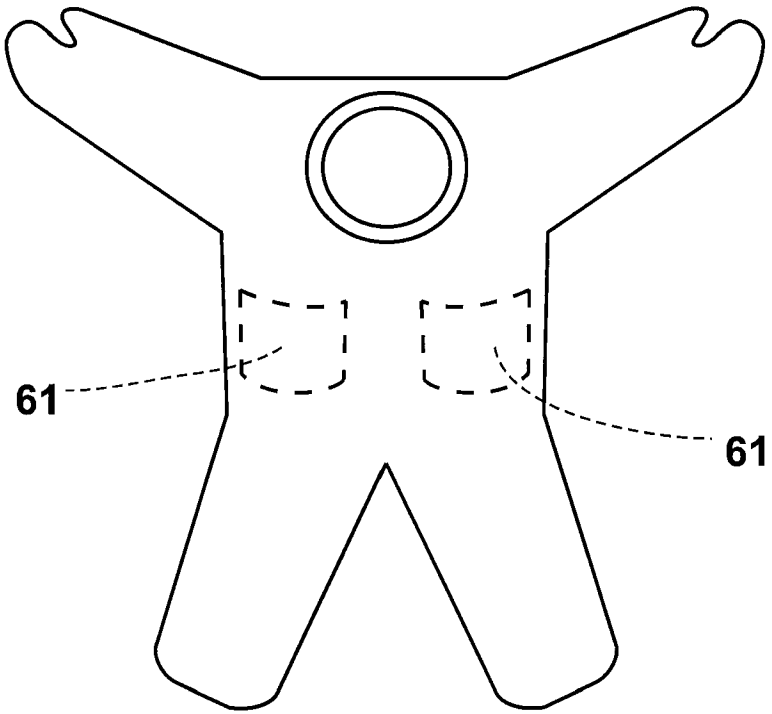

FIG. 19 is a top elevational view of this salvation suit showing the distribution of some compartments and/or pockets to put different elements.

Figure 20:
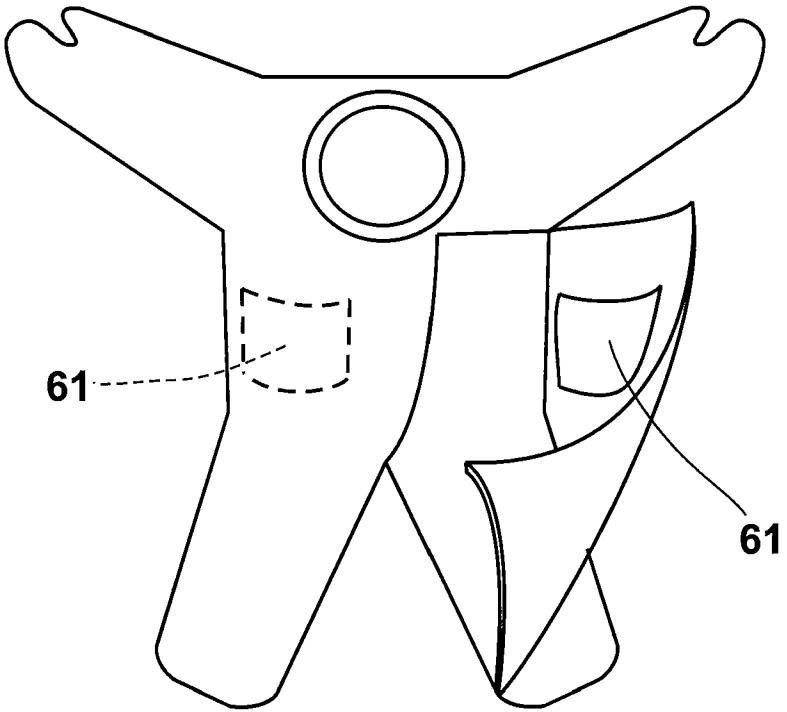

FIG. 20 is a partial longitudinal sectional view of the suit showing the compartment and/or pocket location.

Figure 21:
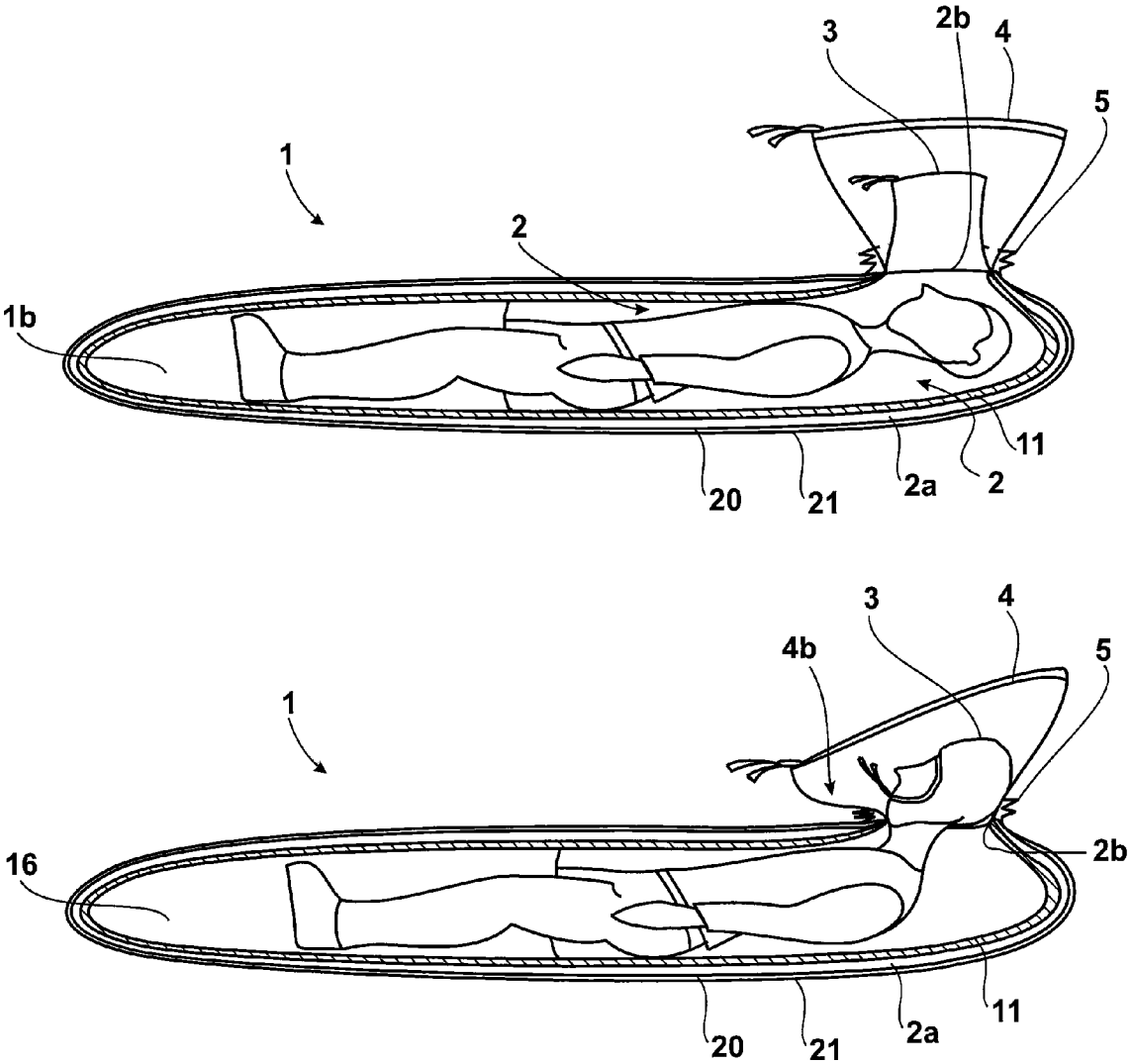

FIG. 21 includes drawings A and B, being:

Drawing A, a longitudinal sectional view of this suit showing the wearer's location, with his body inside the receptacle, and Drawing B, a longitudinal sectional view of this suit showing the wearer's location with his head inside the expansible head sleeve.

In the different drawings, the same reference numbers and/or letters indicate the same or corresponding parts.

LIST OF MAIN REFERENCES (1) Salvation suit
(1*a*) Suit mittens (1).
(1*b*) Suit legs (1).
(1*c*) Suit leg belts (1*b*)
(2) Body receptacle.
(2*a*) Hermetic chamber.
(2*b*) Head opening [through which the body receptacle is accessed (2)].
(3) Expansible head sleeve.
(3*a*) Head seizing means [it fits the expansible head sleeve opening tight (3)].
(3*b*) Head helmet or cover.
(3*c*) Expansible walls.
(3*d*) Display opening.
(3*e*) Head sign.
(4) Expansible outer sleeve.
(4*a*) Outer seizing means [it fits the expansible outer sleeve opening tight (4)].
(4*b*) Adjoining receptacle [formed by the expansible outer sleeve (4) around the expansible head sleeve (3)].
(5) Protection sleeve.
(5*a*) Joint between the expansible head sleeve (3) and the cover sleeve (5).
(11) Inner cover.
(12) First plastic stratum.
(12*a*) First layer of the first plastic stratum (12).
(12*b*) Second layer of the first plastic stratum (12).
(13) Thermo-insulating layer.
(14) Third plastic stratum
(14*a*) Third layer of the third plastic stratum (14).
(14*b*) Fourth layer of the third plastic stratum (14).
(14*c*) Sign layer.
(15) Second alveolar plastic stratum.
(15*a*) Alveolar compartment.
(15*b*) Alveolar wall.
(15*c*) Interalveolar compartments.
(20) Outer cover.
(21) Protection cover.
(22) Top compartment.
(30) Life rope.
(30*a*) Rope anchorage.
(31) Hoisting front anchorage.
(32) Help instrument.
(33) Sign means.
(40) Thermo-insulating accessory.
(41) Accessory back (40).
(42) Cover wings
(42*a*) Rolled or folded cover wings.
(43) Head wing.
(44) Closing means.
(50) Armor.
(51) Suit leg fastening.
(52) Waist fastening.
(53) Front fastening.
(54) Chest fastening.
(55) Crossed back fastening.
(56) Back anchorage.
(60) Thermo-insulating reinforcement.
(61) Front compartments or pockets.

II—DESCRIPTION OF PREFERRED EMBODIMENTS

In general terms, this invention relates to a salvage suit for shipwrecks that includes a loose body receptacle (2) that is capable of containing the shipwrecked body as a floating mini-cabin; this body receptacle (2) is limited by an inner cover (11) that, formed by plastic layers (12)(15)(14), is separate from the outer cover (20) by a hermetic air chamber (2*a*); the body receptacle (2) is accessed through the head opening (2*b*) in which we have a head sleeve (3) and an outer sleeve (4) that can be unfolded.

DETAILED DESCRIPTION

More specifically, this salvage suit (1) includes a receptacle (2) according to the anatomical form of the shipwrecked person. Notwithstanding this, it was conceived to be loose enough to let the wearer move inside said receptacle (2) that, consequently, is like a floating mini-cabin.

The suit sides (1) project a couple of top extensions that end in two close mittens (1*a*), while the bottom part projects a couple of suit legs (1*b*) that end in two close feet.

This body receptacle (2) is limited by al least two covers (11)(20) that consist in an inner cover (11) and in an outer cover (20), separate between them by a hermetic air chamber (2*a*). It was foreseen to include a third cover or protection cover (21) whose composition may give it a delaying capacity against fire or other protection capacities.

The inner cover (11) includes a first (12), a second (15), and a third (13) plastic strata. Inside the first plastic stratum (12), we see a first (12*a*) and a second (12*b*) plastic layers between which there is a thermo-insulating layer (13) formed by a thermo-insulating material, such as aluminum.

The second plastic stratum (15) is of alveolar type. It includes several alveolar compartments (15*a*) filled with air and hermetically close. These compartments are limited by several alveolar walls (15*b*) that connect the first plastic stratum (12) with the third plastic stratum (14). In this form of embodiment, the alveolar compartments (15*a*) have a round form, and so the walls can also determine the formation of inter-alveolar compartments (15*c*).

In the third plastic stratum (14) there is a third (14*a*) and a fourth (14*b*) plastic layer, between which there is also a thermo-insulating layer (13). It was foreseen another form of embodiment in which, outside the thermo-insulating layer (13), but inside the fourth plastic layer (14*b*), there is a sign layer (14*c*), for example, painted with a flashy paint.

The outer cover (20) may include a plastic stratum formed by one or more layers of an appropriate plastic material.

On the other hand, the access to the suit (1) body receptacle (2) may occur through a head opening (2*b*), whose edges are projected in a head sleeve (3) that can be unfolded, surrounded by an outer sleeve (4) that can be unfolded and, in the outside part of said sleeves (3)(4), there is a protection sleeve (5) that can also be unfolded.

The head sleeve (3) that can be unfolded may be formed by a transparent plastic stratum and may end in means to seize the head (3*a*), that let adjust the sleeve edge (3) on the wearer's face. It was also foreseen that the referred head sleeve (3) includes a helmet, hood or cover (3*b*) for the head in order to give a better protection and to wear it on the referred wearer's head. For example, it was foreseen to include a "hood"-type helmet (3*b*) that covers the head and most of the face. This helmet (3*b*) may be structured in a multilayer material that includes plastic, thermo-insulating and protection layers.

An outer sleeve (4) that can be unfolded surrounds said head sleeve (3). Said outer sleeve, that can also be transparent, may be unfolded to create an adjoining receptacle (4*b*) around said head sleeve (3). This adjoining receptacle (4*b*) has different uses. One of them is the possibility to create a protected environment around the shipwrecked head. Another use is that it may be a receptacle to collect rain water.

In the outside part of said outer sleeve (4) there is a protection sleeve (5) made in a fabric similar to that of the suit (1) protection cover (21). This protection sleeve (5) has a joint (5*a*) that circumstantially allows connecting it to the head sleeve (3) that can be unfolded, and so, when the outer sleeve (4) is folded, they can be unfolded together.

For the materials that form the plastic strata (12)(15)(14) it was foreseen the use of compounds such as linear low density polyethylene and bioriented polypropylene. The use of this kind of materials gives high resistance to water and the possibility to form metal layers [microaluminized] that act as thermo-insulating layers (13).

On the other hand, this suit (1) includes an armor whose strips form suit leg seizures (51), trunk seizures (52)(53)(54)(55), and chest and back anchorages (30*a*)(31). More specifically, it includes several strips that are arranged around the suit legs (1*b*), around the central part of the receptacle (2)—where the body trunk is placed—and around the shoulders.

Said strips form a set of suit leg seizures (51), a waist seizure (52), a crossed chest seizure (54) and a set of chest and back seizures.

Said chest and back seizures include a set of chest seizure sections (53) that, connected through the waist seizure (52) and the crossed chest seizure (54), go over the shoulders. From there, the back seizure sections (55) extend and cross until they end in the waist seizure (52).

It was foreseen that, for example, the armor (50) may be fixed to the inner part of the protection cover (21).

The armor (50) also provides at least a set of front anchorages (30*a*)(31) and a back anchorage (56). In a form of embodiment, this back anchorage (56) may be long enough to be normally placed in the front part of the suit (1) where it has a temporary fixation, so that the wearer can use it in case of need.

It was foreseen the use of a thermo-insulating accessory (40) that, as an open vest, is put inside the body receptacle (2). This thermo-insulating accessory (40) includes a back (41) from which a head wing (43) and two side cover wings (42) are projected. These side cover wings (42) may be placed rolled or folded (42*a*) when they are not being used. To use them, they are folded around the shipwrecked body and they are fastened with a zipper (44) that keeps them in that position.

It was foreseen the addition of different auxiliary means. For example, a chest compartment (22) from which a life rope (30), an auxiliary instrument (32), etc. can be used. We can also include other anchorages for ropes, seizing (1*c*) for the suit legs (1*b*), sign means (33), etc.

It was also foreseen the possibility to include a set of thermo-insulating reinforcements (60) of the suit leg that are located at the back of each suit leg (1*b*).

They are thermo-insulating walls that are located between the inner cover (11) and the outer cover (20), at the wearer's knee back part height. The reinforcement includes a first plastic stratum (12) with at least a thermo-insulating layer (13), a second alveolar plastic stratum (15), and a third plastic stratum (14) with at least a thermo-insulating layer (13).

It will be apparent that various modifications can be made in this invention as far as certain construction details and form are concerned, without departing from the scope of the invention as defined in the claims below:

The invention claimed is:

1. Salvage suit for shipwrecks aimed at containing the shipwrecked body inside it, prepared to resist immersion in water, with capacity to float, wherein:

said suit includes a receptacle formed according to the anatomic form of a shipwrecked person, but it is loose enough so that, as a floating mini-cabin, lets the person move inside the receptacle, said receptacle is limited by at least two covers, said covers include an inner cover and an outer cover that are separate between them by a hermetic air chamber, said inner cover includes: at least a first plastic stratum with at least a thermo-insulating layer, a second alveolar plastic stratum and a third plastic stratum with at least a thermo-insulating layer, said outer cover includes at least a plastic stratum, said suit includes a head sleeve that can be unfolded as a head cover, and that has seizing means, and said suit includes an outer sleeve that can be unfolded in the outside part of said head sleeve, and that can form an environmental receptacle around said head sleeve.

2. Salvage suit for shipwrecks according to claim 1 wherein the outer sleeve can be unfolded to create a receptacle that can also be used either to form a protected environment around the head sleeve or to collect rain water.

3. Salvage suit for shipwrecks according to claim 1 wherein said suit includes a protection sleeve that can be unfolded and which is structurally arranged to connect to the head sleeve, is ready to be unfolded until said protection sleeve covers the outside part of said head sleeve.

4. Salvage suit for shipwrecks according to claim 1 wherein said suit includes a second outer layer made in a protection material and that has a distinctive aspect.

5. Salvage suit for shipwrecks according to claim 1 wherein said suit includes a thermo-insulating accessory that, as an open vest, is placed inside the receptacle, wherein walls of said accessory are capable of being folded until they close and cover the shipwrecked body.

6. Salvage suit for shipwrecks according to claim 1 wherein said suit includes an accessible outer compartment inside which there is at least one rope that can be unfolded.

7. Salvage suit for shipwrecks according to claim 1 wherein said suit includes means to fit the suit tight.

8. Salvage suit for shipwrecks according to claim 1 wherein the hermetic air chamber is defined by the partial and hermetic joint of the inner and outer covers.

9. Salvage suit for shipwrecks according to claim 1 wherein the inner cover is placed inside the outer cover, both covers hermetically joined at the neck so that the hermetic air chamber is formed between both covers.

10. Salvage suit for shipwrecks according to claim 1 wherein said suit has an armor member having several strips which form suit legs seizures, trunk seizures, and chest and back anchorages.

11. Salvage suit for shipwrecks according to claim 10 wherein said suit also comprises:

several strips that, when positioned around the suit legs, the trunk and the shoulders create:

a set of suit leg seizures, a waist seizure, a set of back and chest seizures that, separated in the front part, project over the shoulders and cross at the back, and a cross chest seizure that extends between both back and chest seizures.

12. Salvage suit for shipwrecks according to claim 11 wherein said armor member comprises at least a back hoist anchorage that can reach up to the front part, wherein said armor member has front seizure means that keep it within the wearer's hand reach.

13. Salvage suit for shipwrecks according to claim 11 wherein said suit comprises a set of thermo-insulating reinforcement members cooperating with said suit legs that, at the back of each suit leg, comprises each thermo-insulating walls, with stratums and/or layers, located between the inner cover and the outer cover, at the wearer's knee back part height.

14. Salvage suit for shipwrecks according to claim 1 wherein said suit comprises, at least, a material that it is selected from a group that consists of: a plastic-based laminated, low density polyethylene (LDPE) and bioriented polypropylene (BOPP).

15. Salvage suit for shipwrecks according to claim 1 wherein said suit comprises a set of top extensions that end in two close mittens and a set of suit legs that end in two close feet.

* * * * *